US005921785A

United States Patent [19]

Ii

[11] Patent Number: 5,921,785

[45] Date of Patent: Jul. 13, 1999

[54] ELECTRICAL CONNECTOR FOR FLAT CABLES

[75] Inventor: Hidehiro Ii, Kohbe, Japan

[73] Assignee: Molex Incorporated, Lisle, Ill.

[21] Appl. No.: 08/951,120

[22] Filed: Oct. 15, 1997

[30] Foreign Application Priority Data

Dec. 27, 1996 [JP] Japan ..... 8-357851

[51] Int. Cl.[6] ..... H01R 9/07

[52] U.S. Cl. ..... 439/60; 439/495

[58] Field of Search ..... 439/495, 326, 439/329, 60, 492, 630

[56] References Cited

U.S. PATENT DOCUMENTS

| | | | |
|---|---|---|---|
| 3,617,992 | 11/1971 | Ruehlemann et al. | 339/242 |
| 3,980,376 | 9/1976 | Rosen | 339/75 MP |
| 4,526,436 | 7/1985 | Aso | 339/176 MF |
| 4,734,053 | 3/1988 | Imai | 439/495 |
| 5,024,609 | 6/1991 | Piorunneck | 439/637 |
| 5,104,324 | 4/1992 | Grabbe et al. | 439/62 |
| 5,106,311 | 4/1992 | Yodogawa et al. | 439/77 |
| 5,156,554 | 10/1992 | Rudoy et al. | 439/108 |
| 5,201,661 | 4/1993 | Ii | 439/79 |
| 5,203,725 | 4/1993 | Brunker et al. | 439/636 |
| 5,207,598 | 5/1993 | Yamada et al. | 439/636 |
| 5,259,768 | 11/1993 | Brunker et al. | 439/60 |
| 5,259,793 | 11/1993 | Yamada et al. | 439/637 |
| 5,273,461 | 12/1993 | Lee | 439/637 |
| 5,354,214 | 10/1994 | Aso et al. | 439/492 |
| 5,370,552 | 12/1994 | Chishima et al. | 439/495 |
| 5,522,737 | 6/1996 | Brunker et al. | 439/637 |
| 5,580,257 | 12/1996 | Harwath | 439/108 |
| 5,580,272 | 12/1996 | Yamaguchi et al. | 439/495 |
| 5,651,695 | 7/1997 | Lee et al. | 439/495 |

*Primary Examiner*—Steven L. Stephan
*Assistant Examiner*—Brian J. Biggi
*Attorney, Agent, or Firm*—Stephen Z. Weiss

[57] ABSTRACT

Disclosed is an improvement in an electric connector for a flat, flexible cable having conductors on one side comprising: an insulating housing having a cavity to receive the connecting end of a flat, flexible cable and a plurality of terminal pairs parallel arranged at regular intervals and fixed in the cavity; and an actuator slidably nested in the insulating housing. The actuator has a blade to press the connecting end of the flat, flexible cable against the contacts of the terminals of each pair when the blade of the actuator is inserted in the cavity of the insulating housing. The contacts of the terminals of each pair face one side of the blade, and are aligned and spaced from each other in the direction in which the flat, flexible cable is inserted in the cavity of the insulating housing.

The linear arrangement of terminal contacts at two different levels on one side of the cavity relative to the blade of the actuator has the effect of handling an FPC having an increased number of conductors on one side without longitudinally extending the connector size, thus providing a high-conductor density electric connector.

14 Claims, 8 Drawing Sheets

ELECTRICAL CONNECTOR FOR FLAT CABLES

FIELD OF THE INVENTION

This invention generally relates to the art of electrical connectors and, particularly, to an electrical connector for terminating a flat cable or circuit having conductors on one side thereof.

BACKGROUND OF THE INVENTION

A conventional electrical connector for terminating a flat cable, a flat flexible circuit or the like, typically includes an insulating housing having a slot for receiving a connecting end or edge of the cable. A plurality of pairs of terminals are mounted in the housing and arranged at regular spaced intervals longitudinally of the slot. In some applications, an actuator includes a blade for insertion into the slot to press the connecting end of the cable against contact portions of the terminals.

The terminals mounted in the insulating housing cannot be increased in number beyond a certain physical limit of terminal-to-terminal interval spacing. In an attempt to increase the number of conductors to be accommodated by the connector, flat cables are used with conductors on both sides thereof. The two-sided cable is rather expensive to manufacture. As an alternative, an unduly elongated connector could be provided, but this often is not even possible where there are space restrictions on the connector. Flat cables have been proposed with conductors or contact pads in two parallel rows at the connecting end of the cable on only one side thereof. However, the one-sided, multiple-row contact cables cause the connector to be non-symmetrical or unbalanced, because the terminals typically are mounted in the housing, all of the one side of the cable-receiving slot facing the contact/conductor side of the cable. The present invention is directed to solving this myriad of problems in increasing the density of electrical connectors for flat cables or circuits.

It should be understood that the use of the term "flat cable" herein and in the claims hereof is not intended to be limiting in nature, because the concepts of the invention are equally applicable for use in connectors which accommodate flat rigid cable, flat flexible cable, rigid printed circuit boards, flexible circuits and the like. Therefore, the phrase "flat cable" is being used in its broadest or generic sense.

SUMMARY OF THE INVENTION

An object, therefore, of the invention is to provide a new and improved electrical connector for terminating a flat cable. In particular, the flat cable has at least two generally parallel rows of contact pads on one side thereof extending along a connecting edge of the flat cable.

In the exemplary embodiment of the invention, the connector includes an insulating housing having an elongated slot for receiving the connecting edge of the flat cable. A plurality of pairs of terminals are mounted in the housing and spaced longitudinally of the slot. The terminals in each pair include one terminal mounted in the housing on each opposite side of the slot. The terminals in each pair include contact portions on only one side of the slot for engaging the contact pads on the one side of the cable.

As disclosed herein, the contact portion of the terminal in each pair which is mounted on the side of the slot facing the one side of the flat cable, extends directly toward the slot and the one side of the cable. The contact portion of the terminal in each pair which is mounted on the side of the slot opposite the one side of the flat cable is generally U-shaped and extends around the base of the slot and then toward the one side of the cable. The terminals are stamped and formed of sheet metal material, and the contact portions comprise spring arms. Finally, the terminals have tail portions extending generally perpendicular to the slot outside the housing for connection to contact pads on a printed circuit board.

Other features of the invention include an actuator having a blade portion for insertion into the slot on a side of the flat cable opposite the one side thereof, to bias the cable against the contact portions of the terminals. Complementary interengaging latch means are provided between the actuator and the housing defining two positions of engagement between the actuator and the housing. One position allows insertion of the cable into the slot, and a second position biases the cable against the contact portions of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
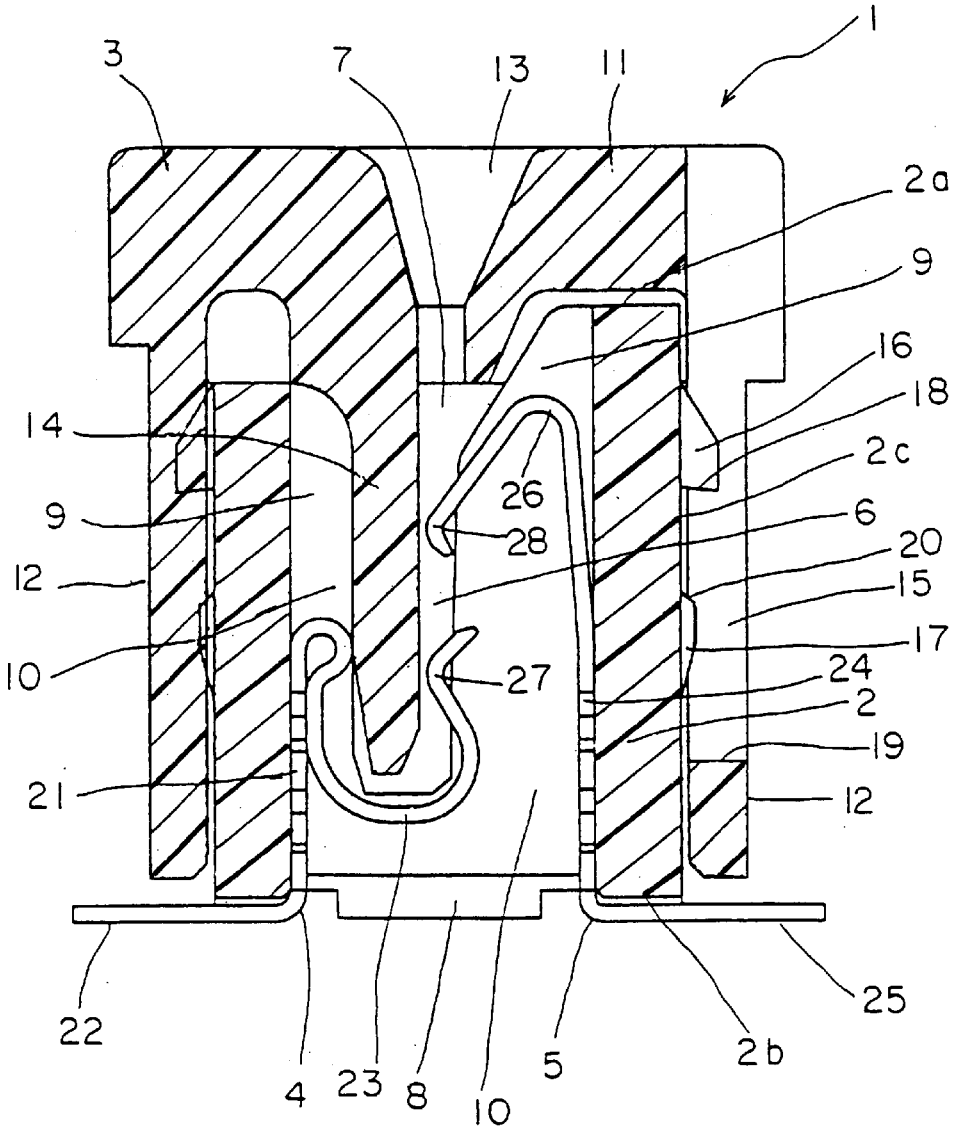
FIG. 1 is a cross-section through the electrical connector according to one embodiment of the invention.
Figure 2:
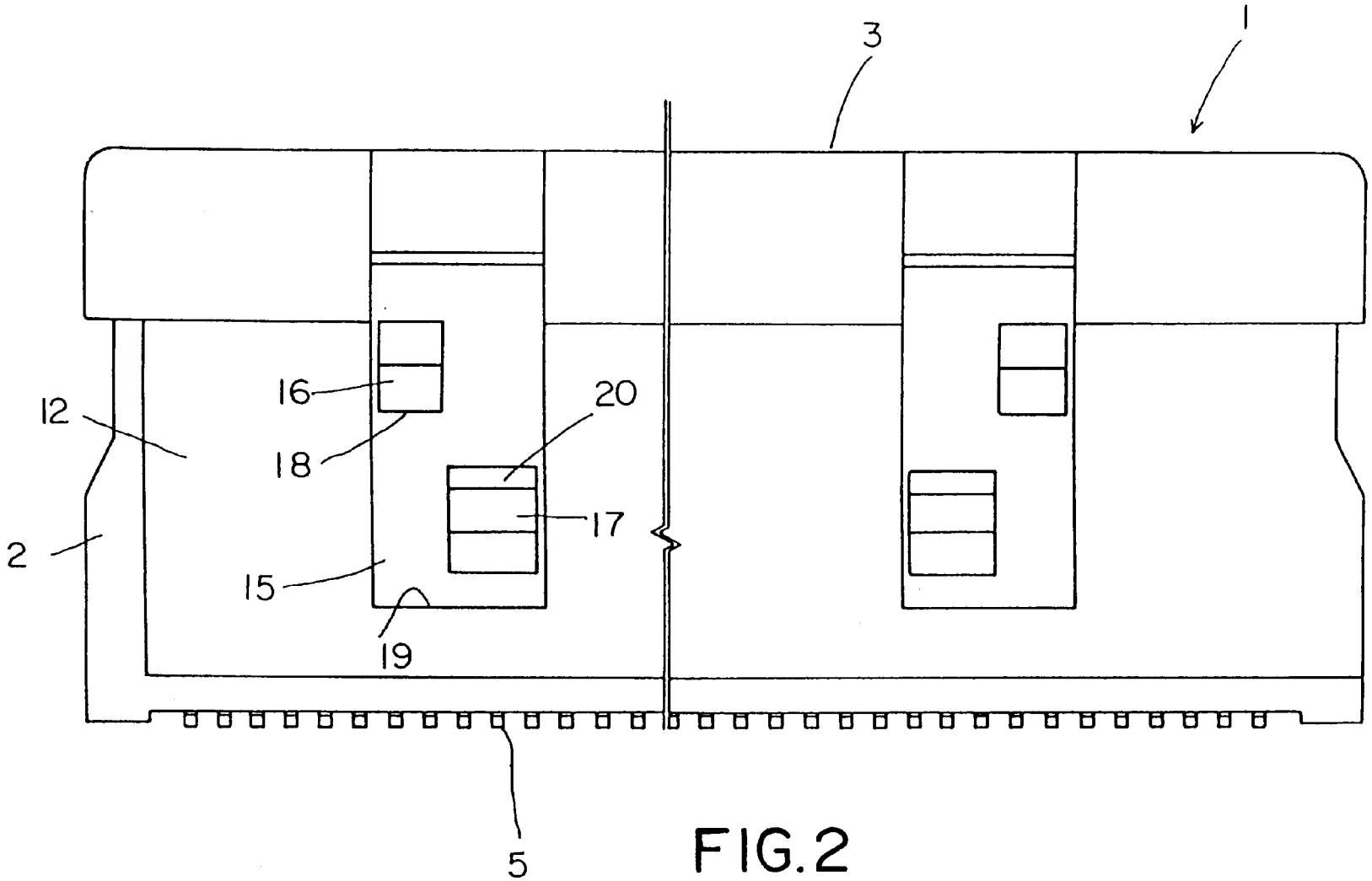
FIG. 2 is a fragmented front elevational view of the connector.
Figure 3:
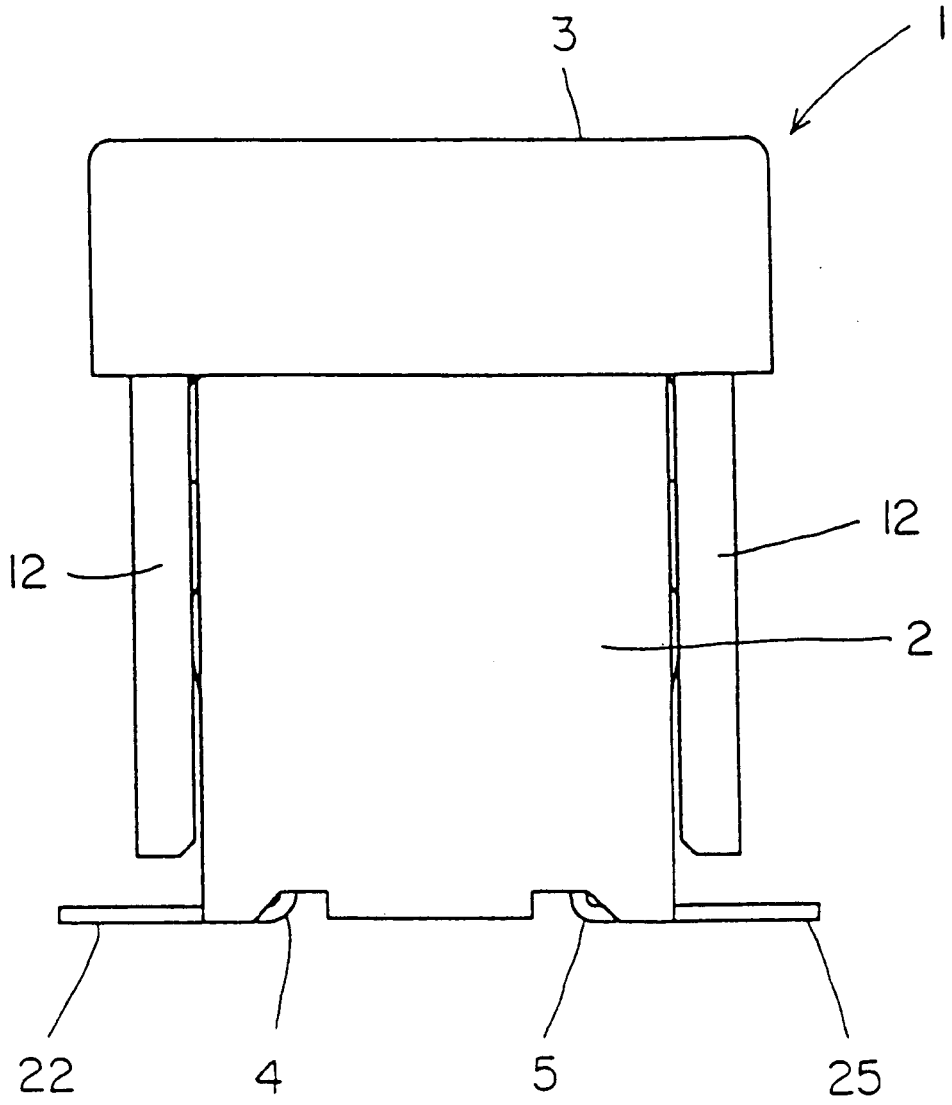
FIG. 3 is an end elevational view of the connector.
Figure 4:
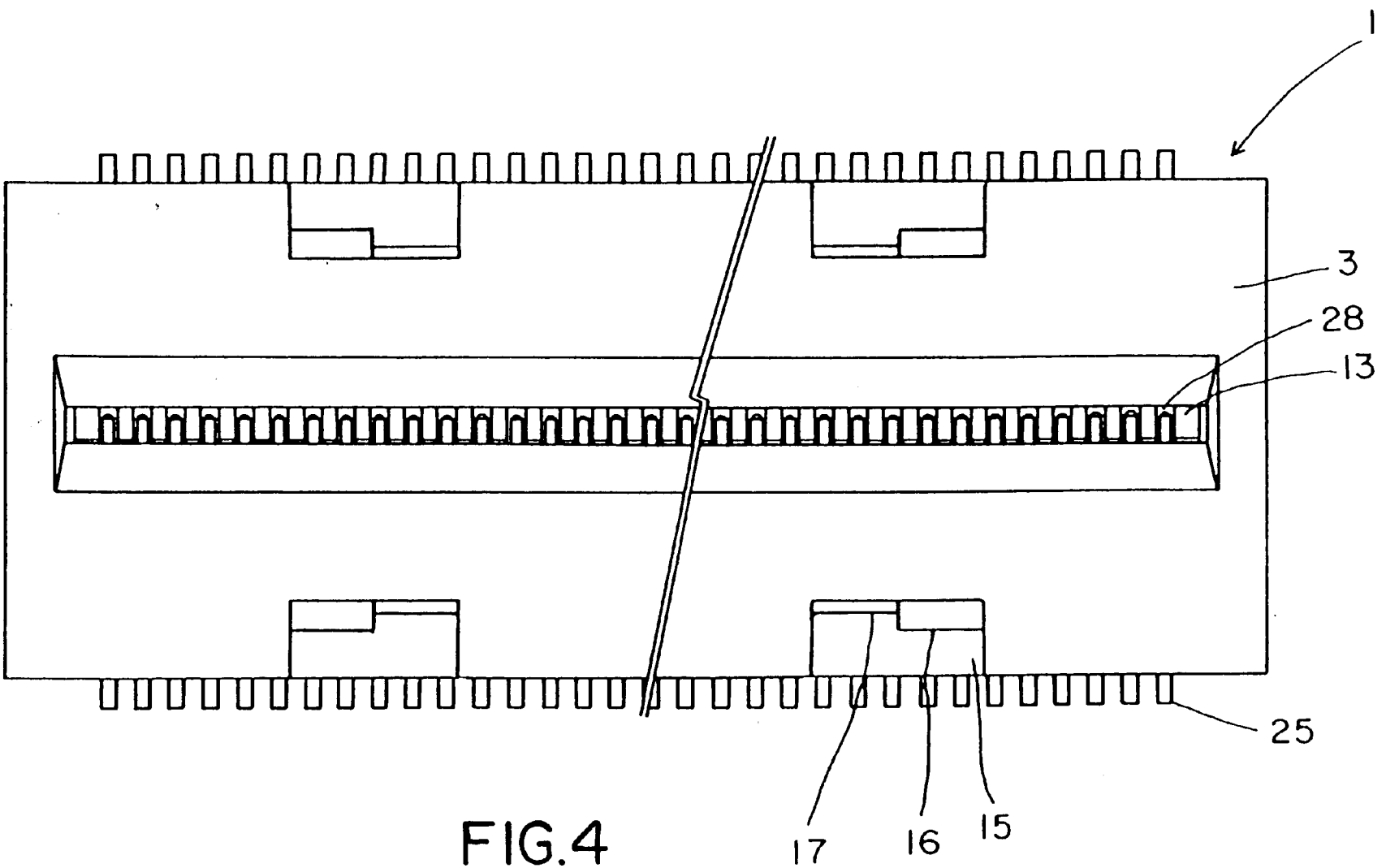
FIG. 4 is a fragmented bottom plan view of the connector.

Referring to the drawings in greater detail, and first to FIGS. 1–4, an upright-type of electrical connector, generally designated 1, is shown to include an insulating housing 2 and an actuator 3 mounted on the housing. The housing is box-like and is a one-piece structure unitarily molded of dielectric material such as plastic or the like. The housing is elongated and includes an elongated slot 6 for receiving the connecting end of a flat cable which will be described in relation to FIG. 8. The housing mounts a plurality of pairs of terminals spaced longitudinally of the slot. The terminals in each pair include terminals 4 and 5 of different shapes.

More specifically, box-like housing 2 is generally open at its top 2*a* and its bottom 2*b*. Slot 6 has a top opening 7 for inserting the connecting end of the flat cable. The bottom of the housing is open, as at 8, for inserting and mounting terminals 4 and 5 in the housing. A plurality of partitions 9 define grooves 10 at regular intervals along slot 6 for press-fitting terminals 4 and 5 therein. Partitions 9 face each other define grooves 10 and are disposed on opposite sides of slot 6.

Figure 5:
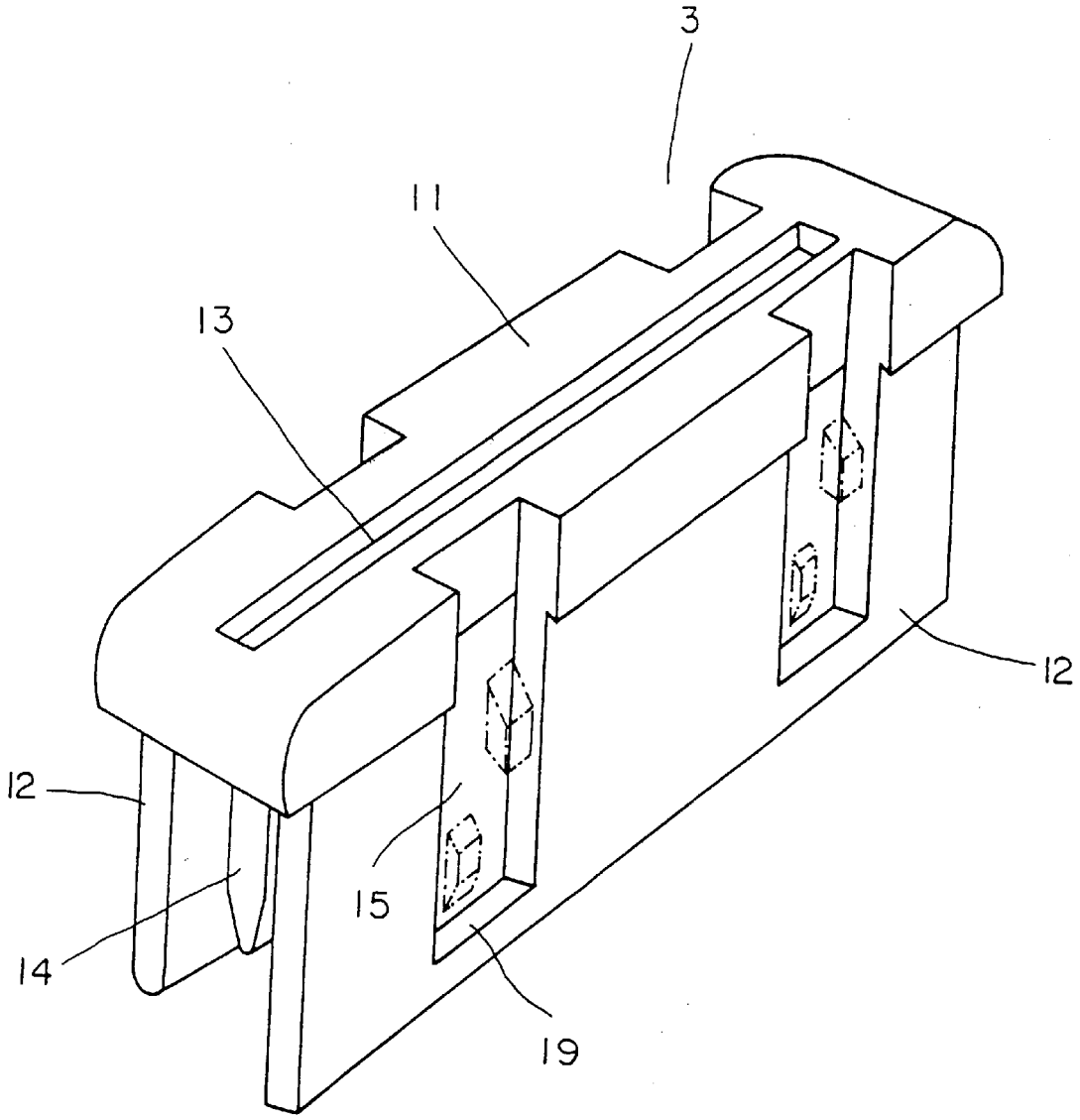
FIG. 5 is a perspective view of the actuator.

Actuator 3 is shown in FIG. 5 and is a one-piece structure molded of dielectric material such as plastic or the like. The actuator includes a cover plate 11 large enough to cover top surface 2*a* of housing 2, two side plates 12 large enough to cover the outer wall surfaces 2*c* (FIG. 1) of the housing and a blade 14 extending downward between opposite side plates 12. The side plates and the blade are integrally molded with cover plate 11 and depend therefrom. Side plates 12 slide on the outer wall surfaces 2*c* of housing 2, and blade 14 is inserted into slot 6 of the housing when the actuator is mounted on the housing. Cover plate 11 has a center elongated slot 13 which is coincident with slot 6 of the housing to permit the cable to pass therethrough, with blade 14 extending along one side of slot 13 of the actuator and into slot 6 of the housing.

Each side plate 12 of actuator 3 has two window openings 15, and housing 2 has upper and lower projections 16 and 17 formed on its outer wall surfaces 2*c*. Upper projections 16 project outwardly a distance greater than lower projections 17, and a lower abutment surface 18 of each upper projection faces an inner edge 19 at the lower edge of window opening 15. When actuator 3 is pulled upwardly relative to the housing, it will stop when lower edges 19 engage abutment surfaces 18 of upper projections 16, thereby preventing unintentional slipping-off of the actuator from the housing.

Figure 6:
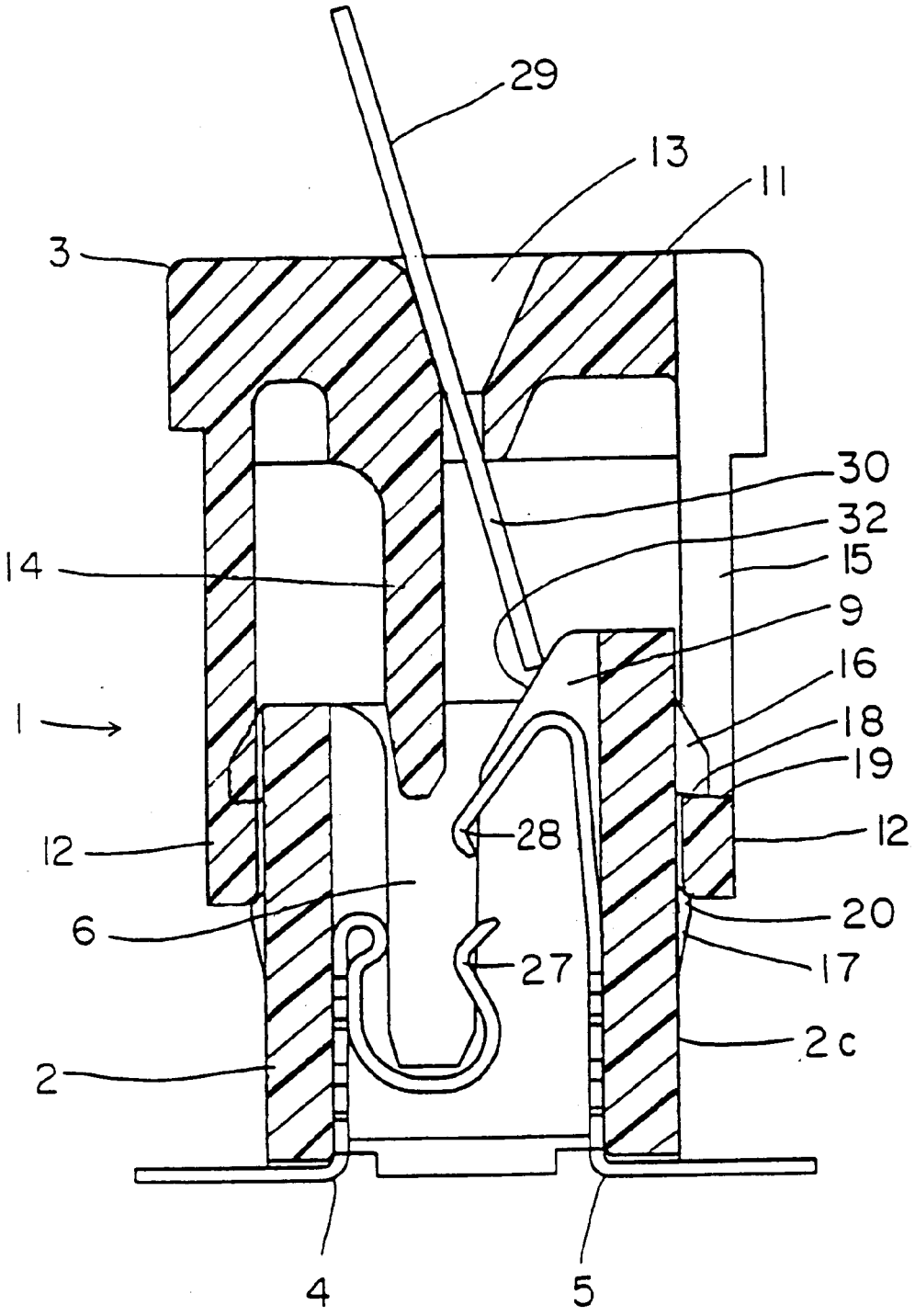
FIG. 6 is a section similar to that of FIG. 1, showing the actuator in its loading position and the flat cable about to be inserted into the connector.
Figure 7:
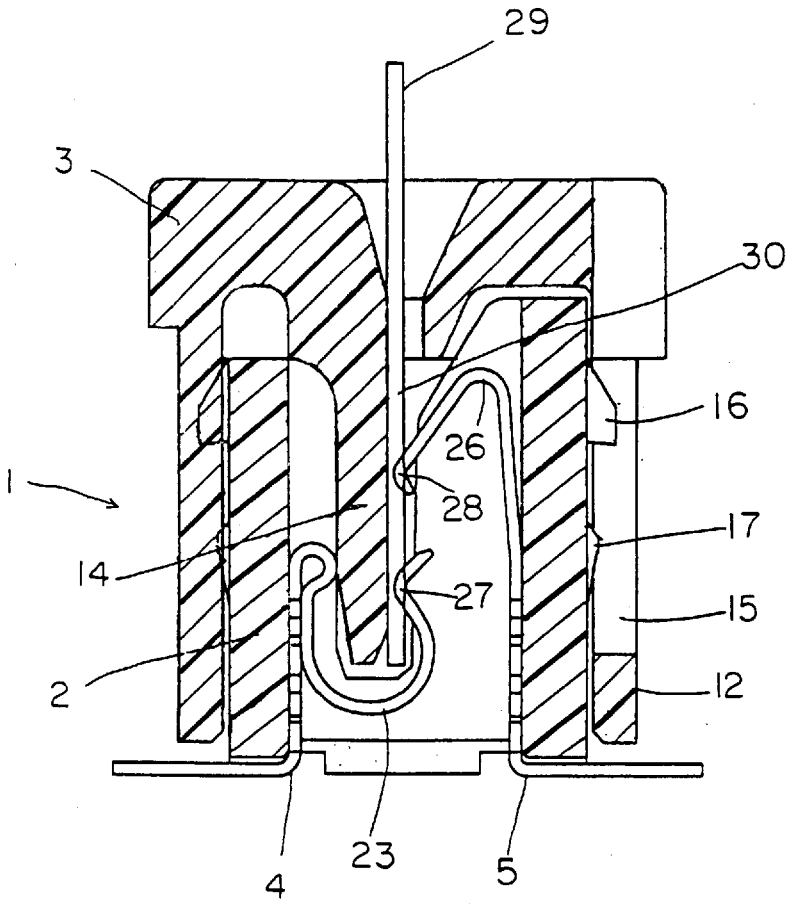
FIG. 7 is a view similar to that of FIG. 6, with the cable fully inserted into the connector and the actuator in its biasing position.

In essence, projections 16 and 17 on opposite sides of housing 2, along with the area of side plates 12 below openings 15 define a complementary interengaging latch means which provides two positions of engagement between actuator 3 and housing 2. One position is shown in FIG. 6 and can be called the "loading" position of the actuator to allow insertion of the cable into the connector. In this position, the area of side plates 12 below openings 15 of the actuator are held between the upper and lower projections as clearly shown in FIG. 6, to hold the actuator in this loading position. In FIG. 7, the actuator has been moved downwardly to a second position which can be called a "biasing" position wherein blade 14 biases the cable against contact portions of the terminals, as described below.

Terminals 4 and 5 are stamped and formed from sheet metal material and, as stated above, are press-fit into grooves 10 between partitions 9 on opposite sides of slot 6 within housing 2. Each terminal 4 includes a mounting stem 21 (FIG. 1) which has serrated or toothed edges for press-fitting into its respective groove 10. A U-shaped spring arm 23 extends from the top of stem 21 around the bottom or base of slot 6 and upwardly toward a contact portion 27. A tail portion 22 projects outwardly of stem 21 generally perpendicular to slot 6 for solder-connection to an appropriate circuit trace on a printed circuit board.

The other terminal 5 also includes a stem 24 which has serrated or toothed side edges for press-fitting the terminal into its respective groove 10. Terminal 5 also has a tail portion 25 for solder connection to an appropriate circuit trace on the printed circuit board. An inverted V-shaped spring arm 26 extends upwardly from stem 24 and terminates in a contact portion 28.

With the above-described configuration of terminals 4 and 5, it can be seen in FIG. 1 that the terminals have contact portions 26 and 28 which face one side of blade 14 of actuator 3 when the actuator is fully mounted on the housing. In other words, the contact portions 26 and 28 of both terminals are disposed on one side of cable-receiving slot 6, notwithstanding the fact that the two terminals are mounted in housing 2 on opposite sides of the slot.

Figure 8:
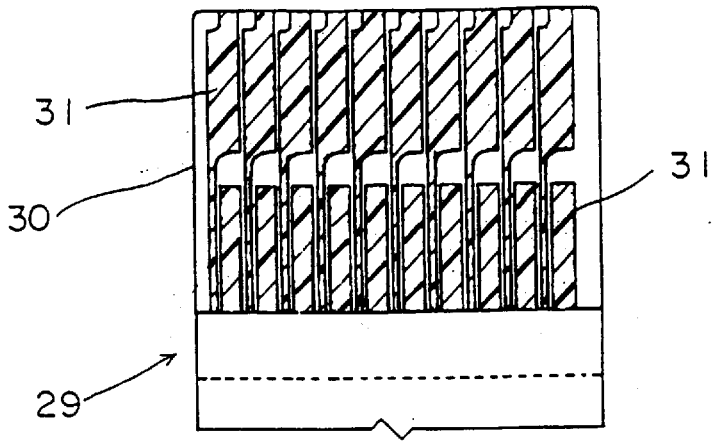
FIG. 8 is a fragmented plan view of the connecting end of a flat cable for use with the connector of the invention.

FIG. 8 shows a connecting end 30 of a flat flexible cable or flexible printed circuit 29. The cable has two generally parallel rows of contact pads 31 on only one side of the cable extending along the edge of connecting end 30 of the flat cable. The outer row of contact pads 30 are spaced from the inner row of contact pads generally equal to the spacing between contact portions 27 and 28 of terminals 4 and 5, respectively.

The operation of terminating cable 29 within connector 1 now will be described, and in particular reference to FIGS. 6 and 7. First, actuator 3 is pulled upwardly relative to housing 2 until the actuator is in its "loading" position shown in FIG. 6 and described above. Then, connecting end 30 of cable 29 is inserted through slot 13 in the actuator and into slot 6 in the housing. Partitions 9 have angled guide surfaces 32 as seen in FIG. 6 to guide the connecting end of the cable into slot 6. After the cable is completely inserted into slot 6 as shown in FIG. 7, actuator 3 is pushed down to complete the termination of the cable as shown in FIG. 7. When the actuator is pushed down, blade 14 of the actuator presses connecting end 30 of flat cable 29 against contact portions 27 and 28 of terminals 4 and 5, respectively. Therefore, contact portions 27 and 28 are yieldably biased against contact pads 31 (FIG. 8) of the cable. FIG. 7 shows contacts 27 and 28 at least partially superposed over the connecting end of the cable, simply to illustrate the extent of yielding of the contact portions. Actually, the contact portions are yieldably deformed outwardly and thereby apply resilient forces against contact pads 31 at connecting end 30 of flat cable 29.

Figure 9:
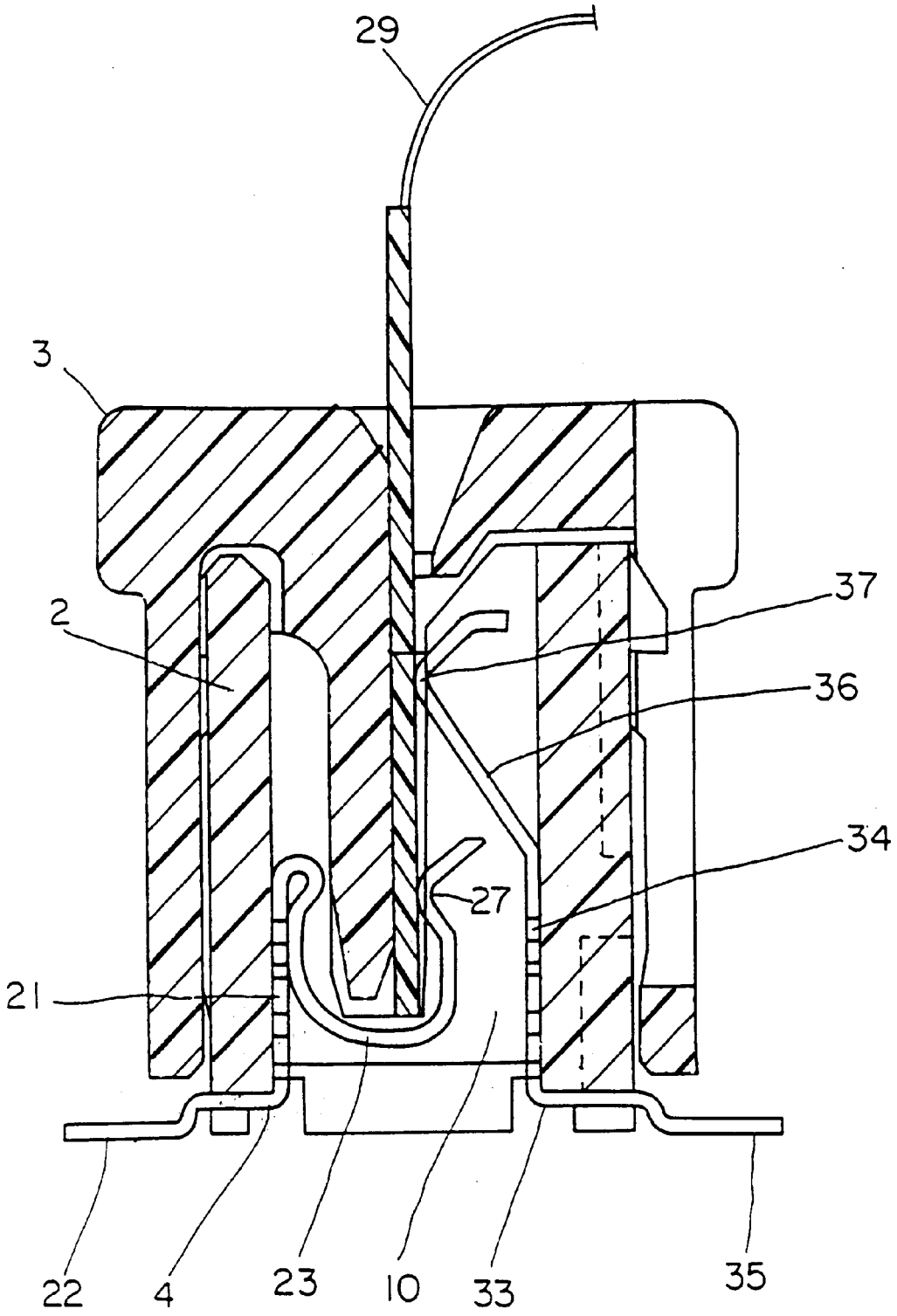
FIG. 9 is a view similar to that of FIG. 7, according to another embodiment of the invention.

Lastly, FIG. 9 shows the use of terminals 33 in place of terminals 4 in the electrical connector described above. Specifically, terminal 33 includes stem 34 and tail portion 35 along with a spring arm 36 leading to a contact portion 37. Instead of the inverted V-shaped configuration of spring arm 26 of terminal 5, spring arm 36 of terminal 33 is generally L-shaped. Nevertheless, spring arm 36 allows contact portion 37 to be yieldably engageable with the contact pads on flat cable 29.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for terminating a flat cable having at least two generally parallel rows of contact pads on one side thereof extending along a connecting edge of the flat cable, comprising:

a housing having an elongated slot for receiving the connecting edge of the flat cable; and a plurality of pairs of terminals mounted in the housing and spaced longitudinally of the slot, the terminals in each pair including one terminal mounted in the housing on each opposite side of the slot, a second terminal of each pair mounted directly opposite the one terminal, and the terminals in each pair including contact portions on only one side of the slot for engaging the contact pads on said one side of the flat cable.

2. The electrical connector of claim 1 wherein the contact portion of the terminal in each pair which is mounted on the side of the slot facing said one side of the flat cable extends directly toward the slot and the one side of the cable.

3. The electrical connector of claim 1 wherein the contact portion of the terminal in each pair which is mounted on the side of the slot opposite said one side of the flat cable is generally U-shaped and extends around the base of the slot and then toward the one side of the cable.

4. The electrical connector of claim 1 wherein said terminals are stamped and formed of sheet metal material having two parallel planar surfaces and said contact portions comprise spring arms and a point of the spring arm contacting the contact pads of the cable formed from a portion of one of the planar surfaces of the sheet metal material.

5. The electrical connector of claim 1 wherein said terminals have tail portions extending generally perpendicular to the slot outside the housing for connection to contact pads on a printed circuit board.

6. The electrical connector of claim 1, including an actuator having a blade portion for insertion into the slot on a side of the flat cable opposite said one side to bias the cable against the contact portions of the terminals.

7. The electrical connector of claim 6, including complementary interengaging latch means defining two positions of engagement between the actuator and the housing, one position allowing insertion of the cable into the slot, and a second position biasing the cable against the contact portions of the terminals.

8. An electrical connector for terminating a flat cable having at least two generally parallel rows of contact pads on one side thereof extending along a connecting edge of the flat cable, comprising:

an insulating housing having an elongated slot for receiving the connecting edge of the flat cable; and a plurality of pairs of terminals mounted in the housing and spaced longitudinally of the slot, the terminals in each pair including one terminal mounted in the housing on each opposite side of the slot, a second terminal of each pair mounted directly opposite the one terminal, the terminal in each pair which is mounted on the side of the slot facing said one side of the flat cable including a contact portion extending directly toward the slot and the one side of the cable, and the terminal in each pair which is mounted on the side of the slot opposite said one side of the flat cable including a contact portion generally U-shaped and extending around the base of the slot and then toward the one side of the cable.

9. The electrical connector of claim 8 wherein said terminals are stamped and formed of sheet metal material having two parallel planar surfaces and said contact portions comprise spring arms and a point of the spring arm contacting the contact pads of the cable formed from a portion of one of the planar surfaces of the sheet metal material.

10. The electrical connector of claim 8 wherein said terminals have tail portions extending generally perpendicular to the slot outside the housing for connection to contact pads on a printed circuit board.

11. The electrical connector of claim 8, including an actuator having a blade portion for insertion into the slot on a side of the flat cable opposite said one side to bias the cable against the contact portions of the terminals.

12. The electrical connector of claim 11, including complementary interengaging latch means defining two positions of engagement between the actuator and the housing, one position allowing insertion of the cable into the slot, and a second position biasing the cable against the contact portions of the terminals.

13. The electrical connector of claim 8 wherein the contact portion of the terminal in each pair which is mounted on the side of the slot facing said one side of the flat cable is generally an inverted V-shape.

14. The electrical connector of claim 8 wherein the contact portion of the terminal in each pair which is mounted on the side of the slot facing said one side of the flat cable is generally L-shaped.

* * * * *